US007808165B2

(12) United States Patent
Kowalski

(10) Patent No.: US 7,808,165 B2
(45) Date of Patent: Oct. 5, 2010

(54) SPARK PLUG WITH FINE WIRE GROUND ELECTRODE

(75) Inventor: Kevin J. Kowalski, Toledo, OH (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 317 days.

(21) Appl. No.: 11/765,179

(22) Filed: Jun. 19, 2007

(65) Prior Publication Data

US 2007/0290593 A1 Dec. 20, 2007

Related U.S. Application Data

(60) Provisional application No. 60/814,733, filed on Jun. 19, 2006.

(51) Int. Cl.
*H01T 13/20* (2006.01)

(52) U.S. Cl. ..... 313/141; 123/169 R

(58) Field of Classification Search ..... 313/141–142, 313/144, 139; 123/169 EL
See application file for complete search history.

(56) References Cited

U.S. PATENT DOCUMENTS

| | | | | |
|---|---|---|---|---|
| 2,642,053 | A | 6/1953 | Dowson | |
| 4,109,633 | A * | 8/1978 | Mitsudo et al. | 123/169 EL |
| 4,514,657 | A | 4/1985 | Igashira et al. | |
| 4,540,910 | A * | 9/1985 | Kondo et al. | 313/11.5 |
| 4,700,103 | A | 10/1987 | Yamaguchi et al. | |
| 5,510,667 | A | 4/1996 | Loffler et al. | |
| 5,527,198 | A | 6/1996 | Chiu et al. | |
| 5,556,315 | A | 9/1996 | Kagawa | |
| 5,574,329 | A | 11/1996 | Kagawa | |
| 5,990,602 | A | 11/1999 | Katoh et al. | |
| 6,215,234 | B1 | 4/2001 | Abe et al. | |
| 6,307,307 | B1 | 10/2001 | Kanao | |
| 6,337,533 | B1 | 1/2002 | Hanashi et al. | |
| 6,373,172 | B1 | 4/2002 | Kanao et al. | |
| 6,603,246 | B2 | 8/2003 | Hori | |

(Continued)

FOREIGN PATENT DOCUMENTS

| | | |
|---|---|---|
| JP | 55126986 | 10/1980 |

(Continued)

*Primary Examiner*—Toan Ton
*Assistant Examiner*—Hana S Featherly
(74) *Attorney, Agent, or Firm*—Robert L. Stearns; Dickinson Wright, PLLC

(57) ABSTRACT

A spark plug for a spark-ignited internal combustion engine includes a generally tubular ceramic insulator. A conductive shell surrounds at least a portion of the ceramic insulator and includes at least one ground electrode. A center electrode is disposed in the ceramic insulator. The center electrode has an upper terminal end and a lower sparking end in opposing relation to the ground electrode, with a spark gap defining the space therebetween. The ground electrode extends from an anchored end adjacent the shell to a distal end adjacent the spark gap. The ground electrode includes a ledge formed on its distal end having at least one inset planar surface and an inset back wall. A high-performance metallic sparking tip is attached to the distal end of the ground electrode. The sparking tip has a base end disposed in surface-to-surface contact with the inset planar surface of the ledge. The inset planar surface completely covers the base end of the sparking tip and extends outwardly therefrom to provide an exposed peripheral interface.

28 Claims, 5 Drawing Sheets

U.S. PATENT DOCUMENTS

| | | | |
|---|---|---|---|
| 6,642,638 | B2 | 11/2003 | Ishiguro |
| 6,653,766 | B2 | 11/2003 | Hori |
| 6,653,767 | B2 | 11/2003 | Morita et al. |
| 6,707,237 | B2 | 3/2004 | Teramura et al. |
| 6,720,716 | B2 | 4/2004 | Shibata et al. |
| 6,791,246 | B2 | 9/2004 | Niessner |
| 6,794,803 | B2 | 9/2004 | Hori et al. |
| 6,798,124 | B2 | 9/2004 | Hiramatsu |
| 6,819,031 | B2 | 11/2004 | Hori |
| 6,844,662 | B2 | 1/2005 | Morita et al. |
| 6,853,116 | B2 | 2/2005 | Hori et al. |
| 6,864,623 | B2 | 3/2005 | Ishikawa |
| 6,923,699 | B2 | 8/2005 | Matsubara et al. |
| 6,997,767 | B2 | 2/2006 | Taniguchi et al. |
| 7,011,560 | B2 | 3/2006 | Downs et al. |
| 2002/0070645 | A1 | 6/2002 | Chiu et al. |
| 2002/0108606 | A1 | 8/2002 | Miwa et al. |
| 2002/0130603 | A1 | 9/2002 | Teramura et al. |
| 2003/0015951 | A1 | 1/2003 | Segawa et al. |
| 2003/0085643 | A1 | 5/2003 | Matsubara |
| 2004/0041506 | A1 | 3/2004 | Teramura et al. |
| 2004/0092193 | A1 | 5/2004 | Musasa et al. |
| 2004/0129683 | A1 | 7/2004 | Torii et al. |
| 2005/0016485 | A1 | 1/2005 | Miwa et al. |
| 2006/0220511 | A1 * | 10/2006 | Hanashi et al. ..... 313/141 |

FOREIGN PATENT DOCUMENTS

| | | |
|---|---|---|
| JP | 61230282 | 10/1986 |

* cited by examiner

SPARK PLUG WITH FINE WIRE GROUND ELECTRODE

This application claims priority to Provisional Patent Application No. 60/814,733, filed Jun. 19, 2006.

BACKGROUND OF THE INVENTION

1. Field of the Invention

The subject invention relates to a spark plug for an internal combustion engine, furnace, or the like, and more particularly to a spark plug having a high performance metal firing tip on its ground electrode.

2. Related Art

Within the field of spark plugs, there exists a continuing need to improve the high temperature oxidation resistance, erosion resistance and reduce the sparking voltage at the center and ground electrodes. To this end, various designs have been proposed using noble metal electrodes or, more commonly, noble metal firing tips applied to standard electrodes. Typically, the firing tip is formed as a pad or rivet or wire of a pure or alloyed precious metal composition, or of other high performance material composition, which is then welded to the end or side of the center electrode, ground electrode or both.

Platinum and iridium alloys are two of the noble metals most commonly used for spark plug firing tips. However, other alloy compositions have been used in various applications, including platinum-tungsten alloys, platinum-rhodium alloys. The use of additional alloy constituents such as yttrium and the like, have also been used with noble metal alloy to improve their operational performance.

While these and various other noble and high performance metal compositions typically provide acceptable spark plug performance, particularly with respect to controlling the spark performance and providing oxidation and spark erosion protection, current spark plugs which utilize noble metal tips have well-known performance limitations associated with the methods which are used to attach the noble metal components. Such attachment methods include the various forms of welding. Therefore, it is highly desirable to develop spark plugs having noble (or other high performance) metal firing tips which accomplish improved spark plug performance and reliability at lower cost and which can be readily affixed to the end of an electrode using known welding techniques. It is also highly desirable to develop methods of making spark plugs that will achieve these performance and reliability improvements using high speed production equipment of the type found in modern manufacturing plants.

A particular area of attention includes the manner in which a high performance metal firing tip is attached to the distal end of the ground electrode. Various techniques have been proposed, including seating the metal firing tip in a notch or pocket formed in the distal end of the ground electrode, as shown in U.S. Pat. No. 6,853,116 to Hori, et al., granted Feb. 8, 2005. A similar technique is shown in U.S. Pat. No. 4,700,103 in the name of Yamaguchi, et al., issued Oct. 13, 1987, as well as in U.S. Pat. No. 5,556,315 to Kagawa issued Sep. 17, 1996.

A more recent movement toward the use of high performance metal firing tips has been motivated by the goal of extending the serviceable life of a spark plug. Current expectations set the serviceable life of a spark plug fitted with a high performance metal firing tip beyond 100,000 miles of operation. As can be appreciated, stringent demands are placed upon the portions of the spark plug exposed to the combustion chamber. Accordingly, the manner in which the metal firing tips are attached to the base electrode components becomes especially important as a spark plug nears the end of its serviceable life. In particular, failure of the weld joint between the metal firing tip and the ground electrode can bring a premature end to the serviceable life of an otherwise high performance spark plug. The addition of sparking tips to the center and ground electrodes add steps to the assembly and manufacturing processes associated with spark plugs which utilize these features. Additionally, it is necessary to maintain precise control of the spark gap between the sparking surfaces located on the sparking tips, including maintaining precise control of the distances between the surfaces as well as their alignment relative to one another. Accordingly, metal firings tip and electrode configurations that facilitate the assembly process, including location and alignment of the sparking tips and surfaces on the center and ground electrodes, thereby lowering the cost of producing spark plugs with high performance metal sparking tips while maintaining the necessary spacing and alignment between them is also very important.

Extension of the spark plug service life, including the weld joints used to attach the high performance sparking tips to the center and ground electrodes, as well as the operating performance of the spark plugs which incorporate them are affected by the ability to remove heat from the sparking tips and electrodes during operation of the spark plug. Currently, copper cored nickel alloy center and ground electrodes are used to improve the thermal conductivity and ability to remove heat from the sparking tips. However, the effectiveness of such electrodes is directly related to the proximity of the high thermal conductivity core material to the sparking tip. The more closely the thermally conductive core material can be placed to the sparking tip, the more heat that can be removed from the sparking tip. Accordingly, the development of sparking tip configurations that permit control of the spacing between the sparking tip and the core material are desirable.

Accordingly, improvements in the manner in which a high performance metal firing tip is attached to the ground electrode are highly desirable within the industry and are useful to improve the performance and extend the serviceable life of a spark plugs of this type.

SUMMARY OF THE INVENTION

The subject invention comprises a spark plug for a spark-ignited internal combustion engine. The spark plug comprises a generally tubular ceramic insulator. A conductive shell surrounds at least a portion of the ceramic insulator and includes at least one ground electrode. A center electrode is disposed in the ceramic insulator. The center electrode has an upper terminal end and a lower sparking end in opposing relation to the ground electrode, with a spark gap defining the space therebetween. The ground electrode extends from an anchored end adjacent the shell to a distal end adjacent the spark gap. The ground electrode includes a ledge formed on its distal end having at least one inset planar surface. A high-performance metallic sparking tip is attached to the distal end of the ground electrode. The sparking tip has a base end disposed in surface-to-surface contact with the inset planar surface of the ledge. A particular advantage of the invention is achieved by the inset planar surface completely covering the base end of the sparking tip and extending outwardly therefrom to provide an exposed peripheral interface whereby optional attachment methods may be applied, if desired, about at least a portion of the exposed periphery of the base end.

Accordingly, the subject invention forms a new and improved construction with which to attach a high-performance metallic sparking tip to the distal end of the ground electrode. The novel construction yields a stronger, more secure joint and facilitates various attachment mechanisms which may include welding or the like. The particular construction lends itself to high speed production techniques. As a result, a spark plug manufactured in accordance with the subject invention can achieve extended service life, exhibits improved performance characteristics, and is conducive to modern manufacturing methods.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
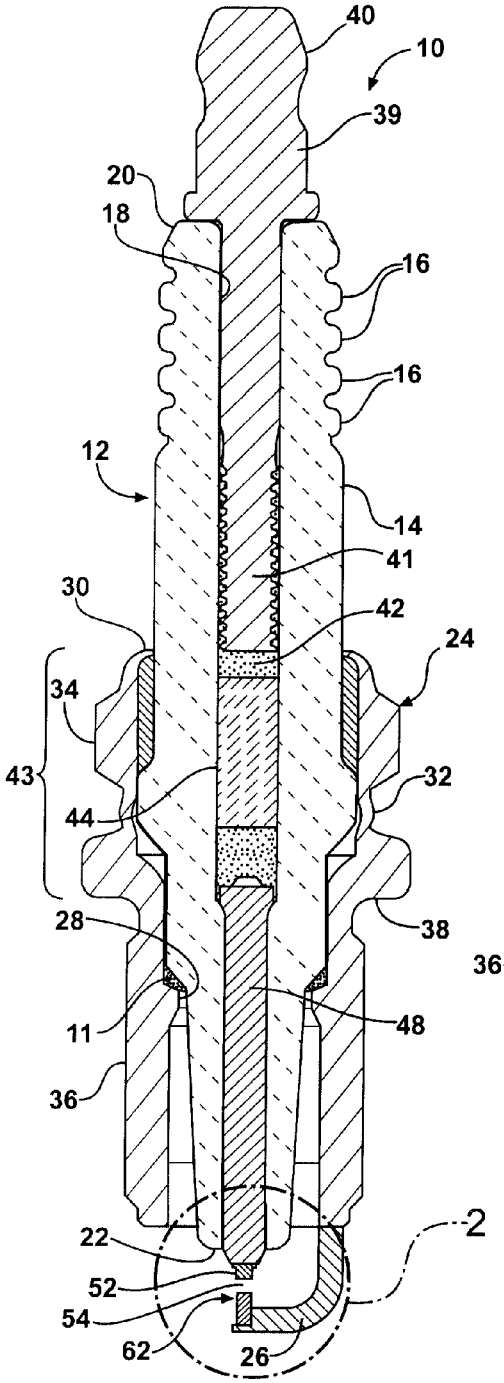
FIG. 1 is a cross-sectional view of a spark plug according to the subject invention.

Referring to the FIGS., wherein like numerals indicate like or corresponding parts throughout the several views, a spark plug is generally shown at 10 in FIG. 1. The spark plug 10 includes a tubular ceramic insulator, generally indicated at 12, which is preferably made from aluminum oxide or other suitable material having a specified dielectric strength, high mechanical strength, high thermal conductivity, and excellent resistance to thermal shock. The insulator 12 may be molded dry under extreme pressure and then sintered at high temperature using well-known processes. The insulator 12 has an outer surface which may include a partially exposed upper mast portion 14 to which an elastomeric spark plug boot (not shown) surrounds and grips to maintain an electrical connection with the ignition system. The exposed mast portion 14, as shown in FIG. 1, may include a series of ribs 16 for the purpose of providing added protection against spark or secondary voltage "flashover" and to improve grip with the elastomeric spark plug boot. The insulator 12 is of generally tubular or annular construction, including a central passage 18, extending longitudinally between an upper terminal end 20 and a lower core nose end 22. The central passage 18 is of varying cross-sectional area, generally greatest at or adjacent the terminal end 20 and smallest at or adjacent the core nose end 22.

An electrically conductive, preferably metallic, shell is generally indicated at 24. Metal shell 24 may be made from any suitable metal, including various coated and uncoated steel alloys. The shell 24 has a generally annular interior surface which surrounded is adapted for sealing engagement with the exterior surface of the mid and lower portions of the insulator 12 and includes at least one attached ground electrode 26. The shell 24 surrounds the lower regions of the insulator 12 and includes at least one ground electrode 26. While the ground electrode 26 is depicted in the traditional single L-shaped style, it will be appreciated that multiple ground electrodes of L-shape, straight or bent configuration can be substituted depending upon the desired ground electrode configuration and the intended application for the spark plug 10.

The shell 24 is generally tubular or annular in its body section and includes an internal lower compression flange 28 adapted to bear in pressing contact against a small lower shoulder of the insulator 12. The shell 24 further includes an upper compression flange 30 which is crimped or formed over during the assembly operation to bear in pressing contact against a large upper shoulder 13 of the insulator 12. Shell may also include a deformable zone 32 which is designed and adapted to collapse axially and radially inwardly in response to heating of deformable zone 32 and associated application of an overwhelming axial compressive force during or subsequent to the deformation of upper compression flange 30 in order to hold shell 34 in a fixed axial position with respect to insulator 12 and form a gas tight radial seal between insulator 12 and shell 24. Gaskets, cement, or other sealing compounds can be interposed between the insulator 12 and shell 24 to perfect a gas-tight seal and improve the structural integrity of the assembled spark plug 10.

The shell 24 may be provided with a tool receiving hexagon 34 or other feature for removal and installation of the spark plug in a combustion chamber opening. The feature size will preferably conform with an industry standard tool size of this type for the related application. The hex size complies with industry standards for the related application. Of course, some applications may call for a tool receiving interface other than a hexagon, such as slots to receive a standard wrench, or other features such as are known in racing spark plug and other applications and in other environments. A threaded section 36 is formed on the lower portion of the metallic shell 24, immediately below a sealing seat 38. The seat 38 may be paired with a gasket (not shown) to provide a suitable interface against which the spark plug 10 seats in the cylinder head and provides a hot gas seal of the space between the outer surface of the shell 24 and the threaded bore in the combustion chamber opening (not shown). Alternatively, the sealing seat 38 may be designed with a tapered seat located along the lower portion of the shell 24 to provide a close tolerance and self-sealing installation in a cylinder head which is also typically designed with a mating taper for this style of spark plug.

An electrically conductive terminal stud 40 is partially disposed in the central passage 18 of the insulator 12 and extends longitudinally from an exposed top post 39 to a bottom end 41 embedded partway down the central passage 18. The top post 39 connects to an ignition wire (not shown)

and receives timed discharges of high voltage electricity required to fire or operate the spark plug 10 by generating a spark in spark gap 54.

The bottom end 41 of the terminal stud 40 is embedded within a conductive glass seal 42, forming the top layer of a composite three layer suppressor-seal pack. The conductive glass seal 42 functions to seal the bottom end 41 of the terminal stud 40 and electrically connect it to a resistor layer 44. This resistor layer 44, which comprises the center layer of the three-layer suppressor-seal pack 43, can be made from any suitable composition known to reduce electromagnetic interference ("EMI"). Depending upon the recommended installation and the type of ignition system used, such resistor layers 44 may be designed to function as a more traditional resistor suppressor or, in the alternative, as an inductive suppressor. Immediately below the resistor layer 44, another conductive glass seal 46 establishes the bottom or lower layer of the suppressor-seal pack 43 and electrically connects terminal stud 40 and suppressor-seal pack 43 to the center electrode 48. Top layer 42 and bottom layer 46 may be made from the same conductive material or different conductive materials. Many other configurations of glass and other seals and EMI supressors are well-known and may also be used in accordance with the invention. Accordingly, electricity from the ignition system travels through the bottom end 41 of the terminal stud 40 to the top portion of conductive glass seal 42, through the resistor layer 44, and into the lower conductive glass seal layer 46.

Conductive center electrode 48 is partially disposed in the central passage 18 and extends longitudinally from its head which is encased in the lower glass seal layer 46 to its exposed sparking end 50 proximate the ground electrode 26. The suppressor-seal pack 43 electrically interconnects the terminal stud 40 and the center electrode 48, while simultaneously sealing the central passage 18 from combustion gas leakage and also suppressing radio frequency noise emissions from the spark plug 10. As shown, the center electrode 48 is preferably a one-piece unitary structure extending continuously and uninterrupted between its head and its sparking end 50. Conductive center electrode 48 is preferably formed from an electrically conductive material which combines high thermal conductivity with high temperature strength and corrosion resistance. Among suitable materials for conductive center electrode 48 are various Ni-based alloys, including various nickel-chromium-iron alloys, such as those designated generally by UNS N06600 and sold under the trademarks Inconel 600®, Nicrofer 7615®, and Ferrochronin 600®, as well as various dilute nickel alloys, such as those comprising at least 92% by weight of nickel; and at least one element from the group consisting of aluminum, yttrium, silicon, chromium, titanium and manganese. These alloys may also include rare earth alloying additions to improve certain high temperature properties of the alloys, such as at least one rare earth element selected from the group consisting of yttrium, hafnium, lanthanum, cerium and neodymium. They may also incorporate small amounts of zirconium and boron to further enhance their high temperature properties as described in commonly assigned, co-pending U.S. patent application Ser. Nos. 11/764,517 and 11/764,528 filed on Jun. 18, 2007 which are hereby incorporated herein by reference in their entirety.

Either one or both of the ground electrode 26 and center electrode 48 can also be provided with a thermally conductive core. This core 27 is shown in the case of ground electrode 26 in FIG. 10. Thermally conductive core is made from a material of high thermal conductivity (e.g., ≧250 W/M*° K) such as copper or silver or various alloys of either of them. Highly thermally conductive cores serve as heat sinks and help to draw heat away from the spark gap 54 region during operation of the spark plug 10 and the associated combustion processes, thereby lowering the operating temperature of the electrodes in this region and further improving their performance and resistance to the degradation processes described herein.

Figure 2:
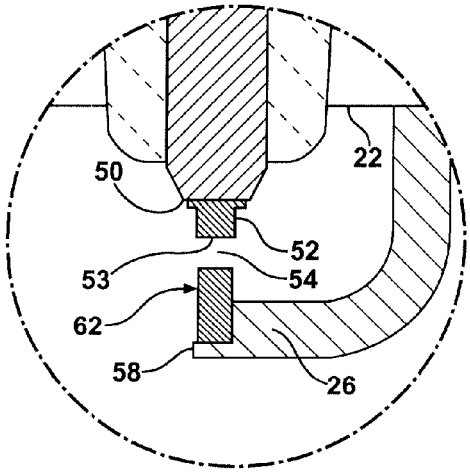
FIG. 2 is an enlarged fragmentary view of the area 2 bounded in FIG. 1 and depicting the ground and center electrodes in the region of the spark gap.
Figure 3:
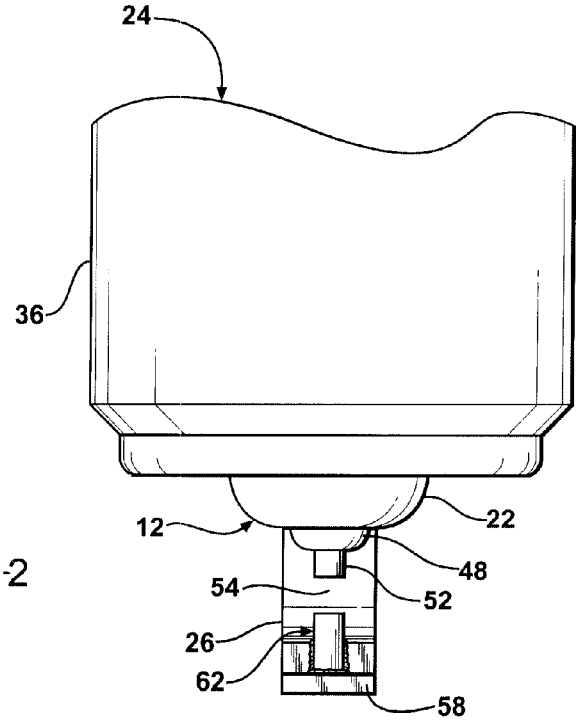
FIG. 3 is a side elevation view of the components illustrated in FIG. 2.
Figure 4:
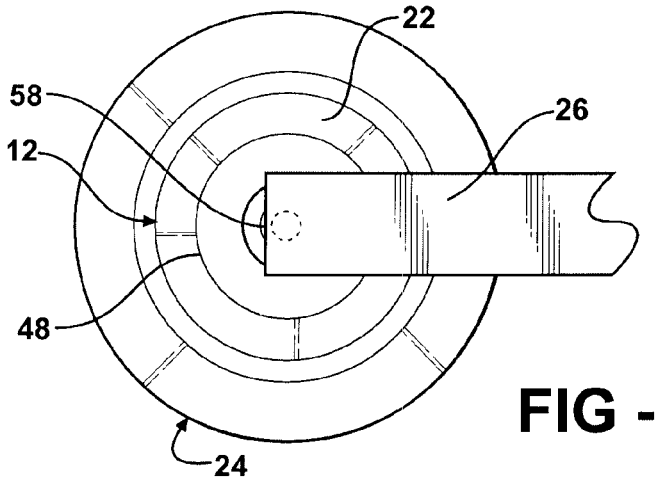
FIG. 4 is a bottom end view of the components illustrated in FIG. 2.

A firing tip 52 is located at the sparking end 50 of the center electrode 48, as perhaps best shown in FIG. 2. The firing tip 52 provides a sparking surface 53 for the emission of electrons across a spark gap 54. The firing tip 52 for the center electrode 48 can be made according to any of the known techniques, including loose piece formation and subsequent attachment by various combinations of resistance welding, laser welding, or combinations thereof, of a pad-like, wire-like or rivet-like member made from any of the known precious metal or high performance alloys including, but not limited to, gold, a gold alloy, a platinum group metal or a tungsten alloy. Gold alloys, including Au—Pd alloys, such as Au-40Pd (in weight percent) alloys. Platinum group metals, include: platinum, iridium, rhodium, palladium, ruthenium and rhenium, and various alloys thereof in any combination. For purposes of this application, rhenium is also included within the definition of platinum group metals based on its high melting point and other high temperature characteristics similar to those of certain of the platinum group metals. Firing tips 52 may also be made from various tungsten alloys, including W—Ni, W—Cu and W—Ni—Cu alloys. Additional alloying elements for use in firing tips 52 may include, but are not limited to, nickel, chromium, iron, manganese, copper, aluminum, cobalt, tungsten, zirconium, and rare earth elements including yttrium, lanthanum, cerium, and neodymium. In fact, any material that provides good erosion and corrosion performance in the combustion environment may be suitable for use in the material composition of the firing tip 52. Further, firing tip 52 may be a composite firing tip 52 having a free end portion located away from the center electrode 48 that includes the sparking surface 53, which is a precious metal or high performance alloy, such as those described above, and a base end portion which is attached to the center electrode 48 on a base end and on the other end to the free end portion. The base end portion may be any material suitable for attachment to the free end portion, such as the Ni-based electrode materials described herein. The free end portion and base end portion may be joined together by any suitable joining method, such as various forms of welding. Depending on the materials selected for use as the free end portion and the base end portion and the joining method employed, the composite sparking tip 52 will also have joint between them. The joint may have a coefficient of thermal expansion (CTE) that is between the CTE's of the materials used for the free end portion and the base end portion, or may fall outside this range, depending on the materials selected for free end portion and the base end portion and the method used to form the joint. This composite or multi-layer sparking tip structure may be formed as a wire or headed rivet. The tip structures and methods of making and using them are explained further in commonly assigned, co-pending U.S. patent application Ser. Nos. 11/602,028; 11/602,146; and 11/602,169 filed on Nov. 20, 2006, which are hereby incorporated herein by reference in their entirety. These sparking tips have numerous advantages, including reduced materials costs as compared to all precious metal or high performance alloy tips. They are also more easily welded to the center or grounds electrodes because the base end may be formed from the same or similar alloys used to make the electrodes, such as various nickel-based alloys. Because they may be made from the same or similar alloys as the electrodes themselves, they also have a significantly reduced CTE mismatch, which improves the resistance to thermal stress and cycling induced cracking and fracture of the interface between the base portion of the sparking tip and the electrode.

Figure 5:
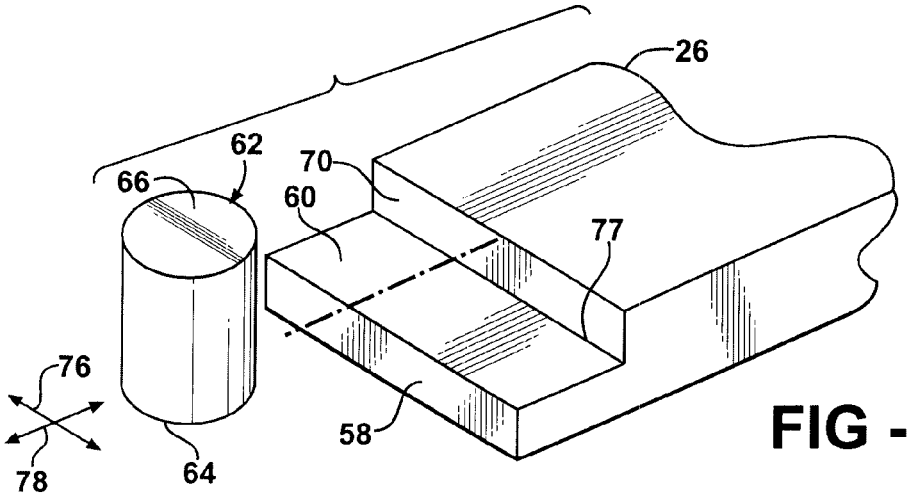
FIG. 5 is a fragmentary perspective view showing a high performance firing tip exploded away from the supporting ledge interface on the distal end of the ground electrode.
Figure 6:
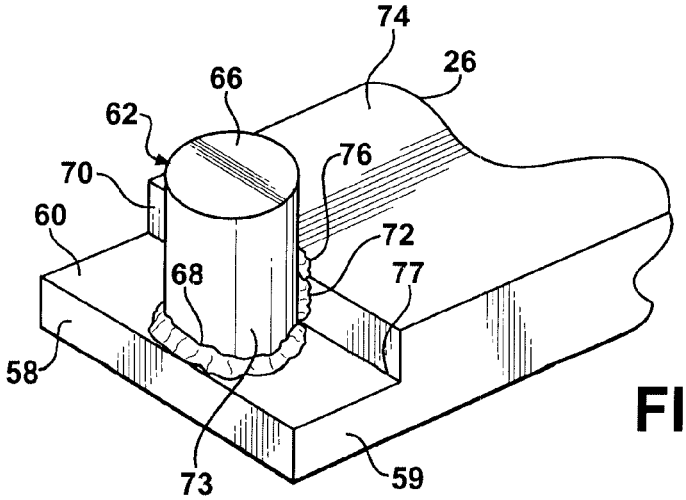
FIG. 6 is an assembled view of the components depicted in FIG. 5 and including a plurality of weld lines metallurgically bonding the two components.

As perhaps best shown in FIGS. 1-4, the ground electrode 26 extends from an anchored end 56 adjacent the shell 24 to a distal end 58 adjacent the sparking gap 54. The ground electrode 26 may be of the typical rectangular cross-section, including an nickel-based alloy jacket surrounding a copper or other thermally conductive material core (see FIGS. 10 and 11). As shown in FIGS. 5 and 6, a ledge 59 is formed on the distal end 58 of the ground electrode 26. This ledge 59 has at least one inset planar surface 60 upon which to support a metallic ground electrode firing tip, generally indicated at 62. The inset planar surface 60 is presented toward the spark gap 54. The ground electrode sparking tip 62 may be fabricated from the same material as the center electrode firing tip 52 or from a dissimilar material, as the application requirements may dictate. Furthermore, the ground electrode sparking tip 62 may be of a geometric configuration which is similar or identical to the center electrode firing tip 52 or vice versa, but this is not a requirement.

The ground electrode sparking tip 62 preferably has a regular cross-section extending continuously between a base end 64 and a free end 66 thereof. Also, while shown as having a regular cross-sectional shape along the length, ground electrode sparking tip 62 may have a cross-sectional shape that varies or changes in size along its length. As shown in the FIGS., this regular cross-section can be circular, thereby resulting in a generally cylindrical construction for the ground electrode sparking tip 62, but other cross-sectional shape are possible, including square and rectangular cross-sectional shapes and bar or plate shapes tips. Sparking tip 62 may also be hemispherical or partially spherical, or conical, or in the form of various pyramidal shapes. In addition, the cross-sectional shape may vary or transition along the length, such as a square base with a cylindrical, hemispherical, conical or pyramidal end and the associated sparking surface 66 (not shown). As noted above, these cross-sectional and shape features may also be included in firing tip 52. The base end 64 of the ground electrode sparking tip 62 rests in full surface-to-surface contact with the inset planar surface 60 formed by the ledge feature. The inset planar surface 60 completely covers the base end 64 of the sparking tip 62 and extends outwardly therefrom to provide an exposed peripheral interface or portion of the inset planar ledge 60, as is perhaps best shown in FIG. 6. The exposed peripheral portion facilitates additional attachment methods, such as welding, as depicted by weld line 68, about at least a portion of the exposed periphery of the base end 64. By this method, the oversized inset planar surface 60 provides a secure, stable foundation for the sparking tip 62 and yields good intersecting surfaces in the form of inside corners which are conducive to attachment by welding or other methods. In fact, a weld line 68 can be formed along most of the exposed portions of this inside corner.

The ledge feature on the distal end 58 of the ground electrode 26 is further defined by an inset back wall 70 against which the ground electrode sparking tip 62 abuts. The back wall 70 is generally perpendicular to the planar surface 60, resulting in a right-angle seat upon which the sparking tip 62 is supported. In the preferred embodiment of this invention, as shown in FIGS. 1-6, the inset back wall 70 is generally planar, resulting in a somewhat squared notch formed into the distal end 58 of the ground electrode 26. In the exemplary cylindrical construction of the sparking tip 62, its rounded side wall abuts against the inset back wall 70 of the ledge forming a line contact, which can be metallurgically bonded with another pair of weld lines 72 (only one of which is visible in FIG. 6). Thus, the pair of weld lines 72 are formed upon the inset back wall 70, whereas the semi-circular weld line 68 is formed upon the planar surface 60. This results in weld lines 68, 72 fixed in non-parallel, preferably perpendicular planes, thus establishing a significant degree of structural rigidity between the sparking tip 62 and the ground electrode 26. This construction also enables the optional addition of an additional peripheral weld bead 76 along the portion of the peripheral surface 73 of sparking tip 62 that is in contact with the upper surface 75 of ground electrode 26. This enables the incorporation of peripheral welds around a portion of the periphery of sparking tip 26 which is out of the plane of peripheral weld bead 68 which offers the ability to further secure the sparking tip 62 to the ground electrode 26 and further influence the structural rigidity of the interconnection between them. The addition of welds 72 and 76 also afford additional thermal pathways through which heat may be extracted from the sparking tip 62 during operation of spark plug 10. Many forms of abutment and attachment combinations are possible depending on the cross-section and shape of sparking tip and the shape and orientation of the ledge 59 and at least one inset planar surface 60. For example, where ledge 59, inset planar surface 60 and inset back wall 70 have the shape shown in FIGS. 5 and 6, a square or rectangular cross-section sparking tip 62 (not shown) may also be beneficial, as it would increase the length of possible contact areas available for weld lines 68, 72 and 76.

Figure 7:
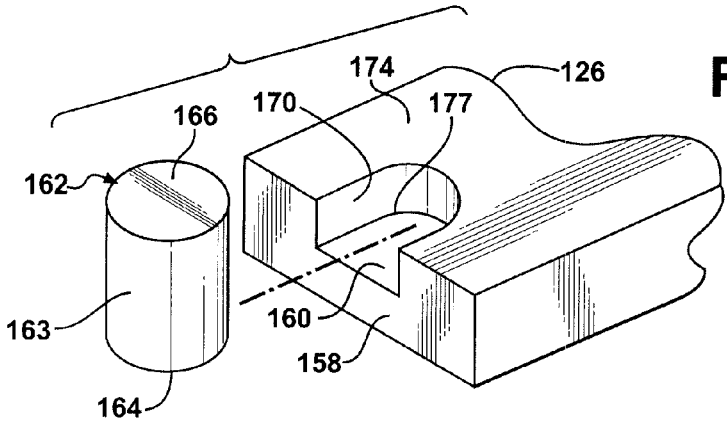
FIG. 7 is a fragmentary exploded perspective view of a first alternative embodiment showing the ledge as a semi-circular pocket.
Figure 8:
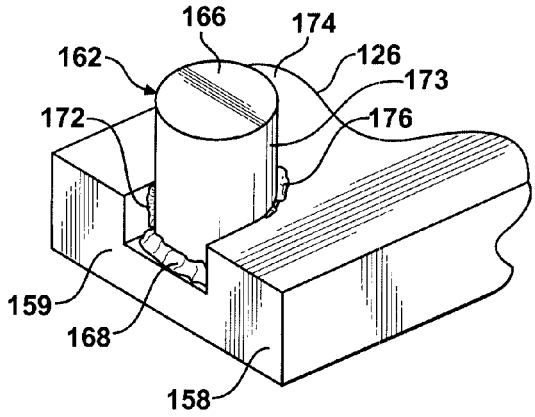
FIG. 8 is a view as in FIG. 7 but showing the components assembled and metallurgically joined together through strategically placed weld lines.

Referring now to FIGS. 7 and 8, a first alternative embodiment of the subject invention is depicted using reference numerals familiar from the preceding embodiment, but including the prefix "1." In this embodiment, the ground electrode 126 is provided with a uniquely formed ledge in the distal end 158. Here, the ledge does not form a continuous feature in the distal end 158, but rather takes the shape of a pocket distinguished by the inset back wall 170 having a generally U-shaped configuration. Thus, the back wall 170 can be characterized by a radius of curvature which is adapted to receive the rounded side wall of the sparking tip 162 in substantial surface-to-surface engagement. The base end 164 of the sparking tip 162, as before, rests in full surface-to-surface engagement with an oversized inset planar surface 160 of the ledge so that portions of the planar surface 160 are exposed even after the sparking tip 162 is fixed in position, as shown in FIG. 8. Here, weld lines 168 can still be applied, if desired, about at least a portion of the exposed periphery at the base end 164. Furthermore, a pair of vertical weld lines 172 (only one of which is visible) can also be applied between the inset back wall 170 and the side wall of the sparking tip 162.

An additional advantage of this arrangement arises out of the extended intersection between the cylindrical side wall of the sparking tip 162 and an exposed upper surface 174 of the ground electrode 126. In this example, a generally semicircular intersection is provided, along which an optional supplemental peripheral weld line 176 can be applied, if desired, as described and for the purposed noted above. Thus, according to this first alternative embodiment of the subject invention, weld lines 168, 172, and 176 can be applied in three separate planes, thus resulting in a securely attached sparking tip 162 to the distal end 158 of the ground electrode 126. These multiple weld lines, combined with the pocketed connection of the sparking tip 162 in the ledge, yield an electrode construction which can substantially extend the service life of the spark plug. In addition, although not shown, it is also within the scope of the invention to combine the ledge 159 as shown, for example, in FIGS. 5 and 6 with a pocket feature as shown in FIGS. 7 and 8.

Figure 9:
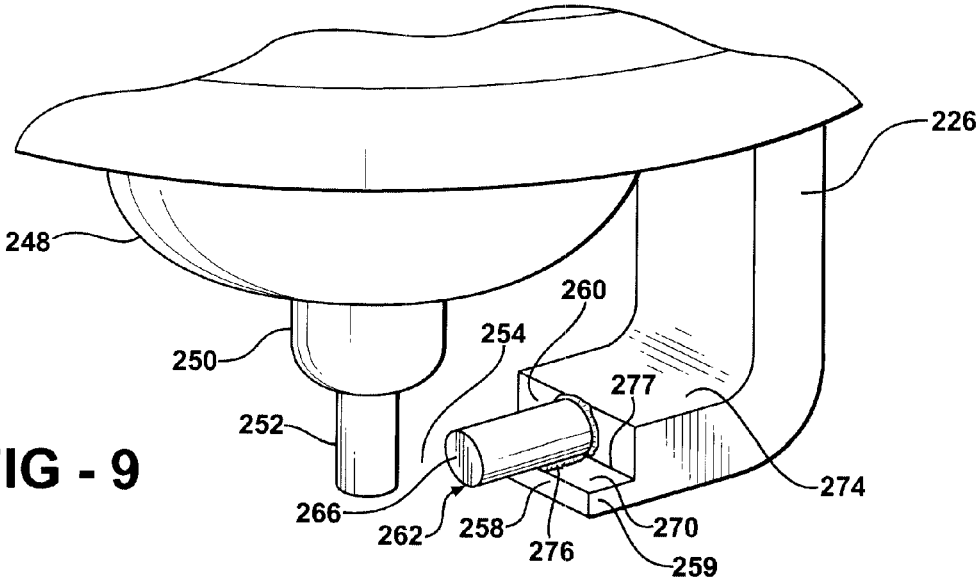
FIG. 9 is fragmentary perspective view of a second alternative embodiment of the subject invention.

Referring now to FIG. 9, a second alternative embodiment of the subject invention as shown. In this second alternative embodiment, like reference numerals corresponding to those components introduced above are again used for the sake of convenience, but with the prefix "2" to facilitate distinction. Here, the orientation of the sparking tip 262 is rotated 90° relative to that of the preferred embodiment. The inset planar surface is again, however, shown facing in the direction of the spark gap 254. As a result of the orientation changes, the inset planar surface 260 and the inset back wall 270 are reversed. Notwithstanding, the semi-circular weld line 268 can still be provided about the base end of the sparking tip 262, with overhanging portions of the oversized inset planar surface 260 providing ample, stable surfaces upon which to accomplish the metallurgical bonding of the sparking tip 262 to the ground electrode 226. Likewise, weld 272 may be added along inset back wall 270 for the purposes described above with respect to the other embodiments. Further, this construction also enables the optional addition of an additional peripheral weld bead 276 along the portion of the peripheral surface 273 of sparking tip 262 that is in contact with the surface 159 of distal end 158 of ground electrode 226.

Figure 10:
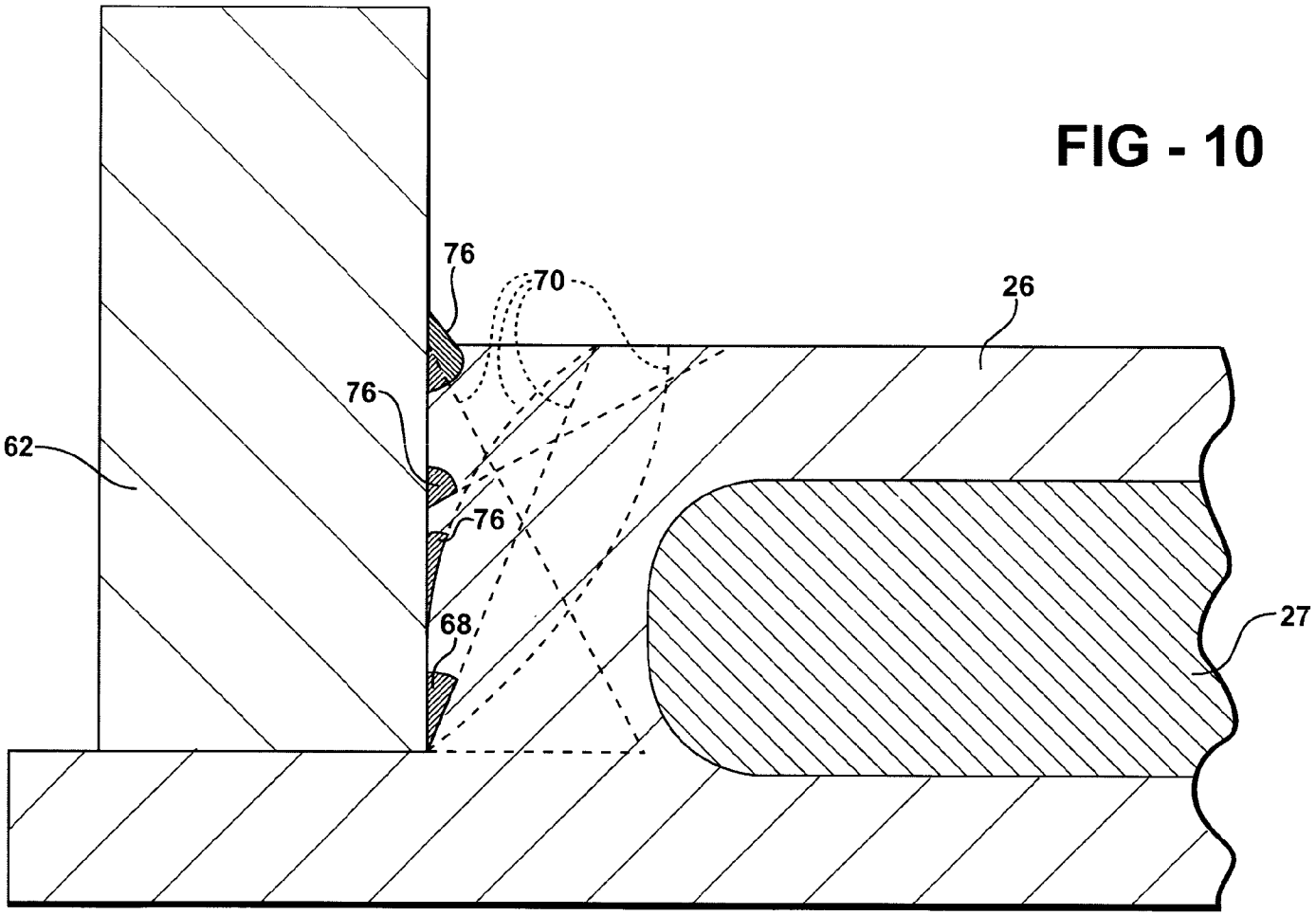
FIG. 10 is a fragmentary cross-section view of a ground electrode illustrating various alternate inset backwall profiles.
Figure 11:
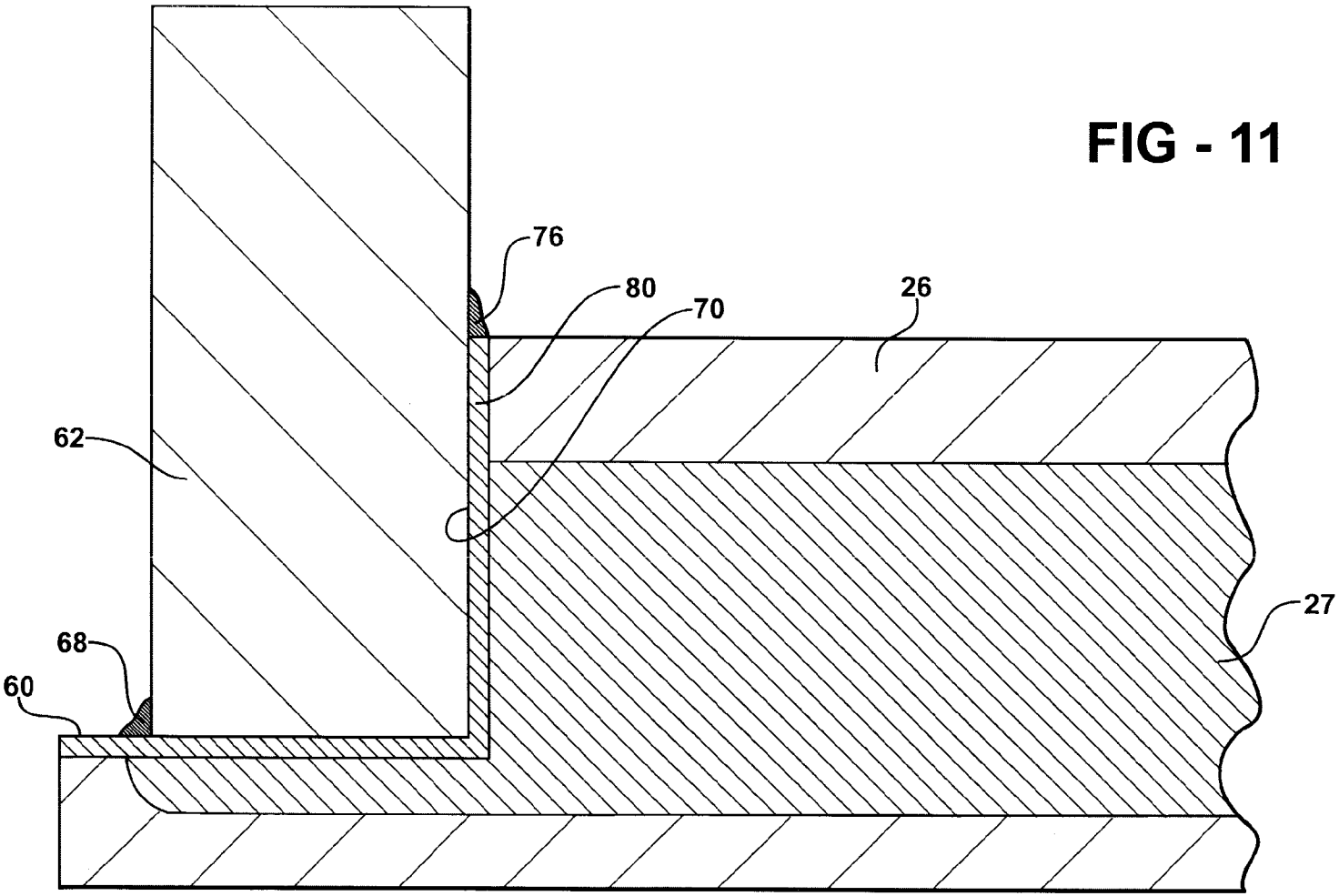
FIG. 11 is a fragmentary cross-section view of a ground electrode illustrating an alternate embodiment of locating the conductive core.

Referring now to FIG. 10, while shown in FIGS. 1-9 as being generally flat planar and orthogonal to inset planar surface 60, inset back wall 70 may have any orientation and shape with respect to inset planar surface 60. It may be a flat planar wall 70 having a non-orthogonal orientation having either an acute or obtuse angled cross-section profile with respect to inset planar surface 60 such that inset back wall 70 tapers into or away from sparking tip 62. The inset back wall 70 may also have all manner of curved cross-section profiles, including generally convex, concave or other curved profiles as illustrated schematically in phantom in FIG. 10, such that inset back wall 70 has a generally curved profile. Various tapered or curved profiles may be beneficial to provide an edge 77, 177, 277 that can be used for the transverse 76 and longitudinal 78 alignment of the sparking tip 62, 162, 262 with respect to inset planar surface 60 and inset back wall 70. In addition to various cross-section profiles that may be incorporated into inset back wall 70, inset back wall 70 may also incorporate various contours along its length. For example, FIGS. 5 and 6 illustrate a generally planar form of inset back wall 70 in contrast, FIGS. 7 and 8 illustrate a curved contour in inset back wall 70 which incorporates a radius of curvature. In FIGS. 7 and 8 inset back wall 70 and inset planar surface 62 form a pocket for receiving sparking tip 62. Other contours, such as one having a generally planar portion (FIGS. 5 and 6) combined with a generally curved portion (FIGS. 7 and 8) (not shown), are also possible and to be included within the scope of this invention. These profile and wall contours may also facilitate the extension of peripheral welds 68, 168, 268 or location of supplemental welds 76,176,276 along other portions of peripheral surface 73,173,273. The incorporation of tapered or curved profiles as described above may also be used to provide more or less space between sparking surface 66 and sparking tip 62 and upper surface 74 of ground electrode 26. This may be desirable to prevent or reduce the likelihood of inadvertent sparking to the upper surface 74 of ground electrode 26 during operation of spark plug 10, particularly with respect to deposits that may occur on the sparking surface 66 or upper surface 74 of electrode 26 during operation of the spark plug. Also, as illustrated in FIGS. 10 and 11, these profiles and contours may facilitate location of sparking tip 62,162,262 in closer proximity to thermally conductive core 27,127,227 to enhance the removal of heat from the sparking tip 62,162,262 during operation of spark plug 10. As shown in FIG. 11, this includes forming ledge 59 in distal end 58 of ground electrode 26 such that sparking tip 62 has an increased portion of thermally conductive core 27 proximate the tip by virtue of having thermally conductive core 27 proximate sparking tip 62 on two points of contact, namely base end 64 and peripheral surface 63. This may be done by, for example, by manufacturing ground electrode 26 with core 27 located closer to the distal end 58 than done conventionally and then machining ledge 59 so that core 27 is exposed as described above. In this configuration, it may also be desirable to provide coating 80, by plating or other known coating methods, to form inset planar surface 60 and inset back wall surface 70 and cover the exposed portions of core 27 with a nickel, nickel-based alloy or other coating 80 to maintain the resistance to high temperature oxidation and corrosion while providing the thermal benefits described above. Another way in which core 27 may be located in closer proximity to sparking tip 62 is a variant of the configuration illustrated in FIG. 11 where ground electrode 26 is formed with core 27 positioned internally such that ledge 59 and inset planar surface 60 may be formed without removal of a portion of core 27 but with core 27 being located under inset planar surface 60 such that it is proximate to and at least partially extending under the base under of sparking tip 62, and more preferably extending completely under the base end of sparking tip 62, such that the removal of the heat from sparking tip 62 is facilitated and improved during operation of spark plug 10.

The attachment of sparking tip 62 is preferably made by welding as described herein. It is preferred to attach sparking tip 62 to inset planar surface 60 using a resistance weld between the base end 64 of sparking tip 62 and inset planar surface 60, such that the weldment and associated heat affected zone is located under the sparking tip between these elements. As mentioned welds may also be made around the exposed portion of the peripheral interface between these elements. It is preferred that these welds be laser welds formed by laser welding. Welds made to abutting portions of inset back wall and peripheral surface of sparking tip 62 and upper surface 74 may also be made as described herein. It is preferred that these welds also be laser weld.

Although the geometric configuration of the ground electrode throughout these various embodiments has been depicted as rectangular in nature and the geometric construction of the sparking tip has been shown as generally cylindrical, these are not constraints. Rather, the ground electrode and its sparking tip can take any geometric configuration or construction.

A spark plug formed in accordance with the disclosed construction for supporting and attaching the sparking tip to the ground electrode results in a robust, effective design which is inexpensive to produce in modern manufacturing facilities and results in extended service life for the spark plug. Thus, enhanced performance can be achieved over a longer service life.

Obviously, many modifications and variations of the present invention are possible in light of the above teachings. It is, therefore, to be understood that within the scope of the appended claims, the invention may be practiced otherwise than as specifically described.

What is claimed is:

1. A spark plug for a spark-ignited internal combustion engine, said spark plug comprising:

a generally tubular ceramic insulator;

a conductive shell surrounding at least a portion of said ceramic insulator, said shell including at least one ground electrode;

a center electrode disposed in said ceramic insulator, said center electrode having an upper terminal end and a lower sparking end in opposing relation to said ground electrode with a spark gap defining the space therebetween;

said ground electrode extending from an anchored end adjacent said shell to a distal end adjacent said spark gap, said ground electrode including a ledge formed on said distal end, said ledge having at least one inset planar surface;

a sparking tip located on said distal end of said ground electrode, said sparking tip having a base end attached to said inset planar surface of said ledge and a side peripheral surface extending from said base end;

said inset planar surface intersecting said distal end of said ground electrode and completely covering said base end of said sparking tip, said inset planar surface being oversized in area relative to said base end so as to extend outwardly therefrom to provide an exposed peripheral interface portion of said inset planar surface adjacent said base end;

said ledge further including an inset back wall spaced from said distal end and intersecting said planar surface, said peripheral surface of said sparking tip directly abutting said back wall of said ledge; and at least one weld bonding said base end of said sparking tip to said inset planar surface, and at least one weld bonding said peripheral surface of said sparking tip to said back wall of said ledge.

2. The spark plug of claim 1, wherein said inset back wall has a contour along a length thereof and a cross-section profile.

3. The spark plug of claim 2, wherein the contour of said inset back wall is generally planar along its length.

4. The spark plug of claim 2, wherein the contour of said inset back wall is curved along its length.

5. The spark plug of claim 2, wherein the contour of said inset back wall has a generally planar portion and a curved portion along its length.

6. The spark plug of claim 1, wherein said inset back wall is substantially orthogonal to said inset planar surface.

7. The spark plug of claim 6, wherein said inset back wall has at least one of a tapered or a curved cross-section profile.

8. The spark plug of claim 1, wherein said inset back wall is not orthogonal to said inset planar surface.

9. The spark plug of claim 8, wherein said inset back wall has at least one of a tapered or a curved cross-section profile.

10. The spark plug of claim 1, wherein said at least one weld comprises a resistance weld between said base end of said sparking tip and said inset planar surface.

11. The spark plug of claim 1, wherein said at least one weld disposed on said peripheral surface of said sparking tip comprises a laser weld.

12. The spark plug of claim 1, wherein said ground electrode includes at least one exposed upper surface extending between said anchored end and said distal end, said exposed surface intersecting and abutting said sparking tip at said back wall of said ledge, and wherein said at least one weld comprises a weld disposed at the intersection between said exposed surface and said sparking tip.

13. The spark plug of claim 1, wherein said sparking tip comprises one of gold, a gold alloy, a platinum group metal or a tungsten alloy.

14. The spark plug of claim 13, wherein said platinum group metal comprises at least one element selected from the group consisting of platinum, iridium, rhodium, palladium, ruthenium and rhenium.

15. The spark plug of claim 14, wherein said platinum group metal further comprises at least one element selected from the group consisting of nickel, chromium, iron, manganese, copper, aluminum, cobalt, tungsten, yttrium, zirconium, hafnium, lanthanum, cerium and neodymium.

16. The spark plug of claim 13, further comprising a firing tip attached to said sparking end of said center electrode.

17. The spark plug of claim 1, wherein said sparking tip is a multi-layer sparking tip having a free end portion and a base end portion.

18. The spark plug of claim 17, wherein said free end portion comprises one of gold, a gold alloy, a platinum group metal or a tungsten alloy and said base end portion comprises one of nickel or a nickel-based alloy.

19. The spark plug of claim 18, wherein said platinum group metal comprises at least one element selected from the group consisting of platinum, iridium, rhodium, palladium, ruthenium and rhenium.

20. The spark plug of claim 19, wherein said platinum group metal further comprises at least one element selected from the group consisting of nickel, chromium, iron, manganese, copper, aluminum, cobalt, tungsten, yttrium, zirconium, hafnium, lanthanum, cerium and neodymium.

21. The spark plug of claim 18, further comprising a firing tip attached to said sparking end of said center electrode.

22. The spark plug of claim 21, wherein said sparking tip comprises one of gold, a gold alloy, a platinum group metal or a tungsten alloy.

23. The spark plug of claim 1, wherein said sparking tip has a regular cross-section extending continuously between said base end and a free end thereof.

24. The spark plug of claim 23, wherein said sparking tip is generally cylindrical, with said base and free ends being generally circular.

25. The spark plug of claim 1, wherein said ground electrode also includes a thermally conductive core located proximate said sparking tip.

26. The spark plug of claim 25, wherein said thermally conductive core extends at least partially under said inset planar surface.

27. The spark plug of claim 26, wherein said thermally conductive core is also located proximate at least a portion of said inset back wall.

28. The spark plug of claim 25, wherein said thermally conductive core extends entirely under said base end of said sparking tip.

* * * * *